US009255425B2

(12) United States Patent
Wittke et al.

(10) Patent No.: US 9,255,425 B2
(45) Date of Patent: Feb. 9, 2016

(54) CLOSING DEVICE FOR A DOOR

(75) Inventors: Norman Wittke, Albstadt (DE); Oliver Hirschoff, Albstadt (DE)

(73) Assignee: ASSA ABLOY Sicherheitechnik GmbH (DE)

( * ) Notice: Subject to any disclaimer, the term of this patent is extended or adjusted under 35 U.S.C. 154(b) by 777 days.

(21) Appl. No.: 13/388,189

(22) PCT Filed: Jul. 31, 2010

(86) PCT No.: PCT/EP2010/004703
§ 371 (c)(1),
(2), (4) Date: Mar. 26, 2012

(87) PCT Pub. No.: WO2011/015324
PCT Pub. Date: Feb. 10, 2011

(65) Prior Publication Data

US 2012/0174337 A1 Jul. 12, 2012

(30) Foreign Application Priority Data

Aug. 1, 2009 (DE) ..... 10 2009 035 737

(51) Int. Cl.
*E05B 15/02* (2006.01)
*E05B 17/00* (2006.01)

(52) U.S. Cl.
CPC ..... *E05B 17/0029* (2013.01); *Y10T 16/27* (2015.01); *Y10T 16/276* (2015.01); *Y10T 16/281* (2015.01); *Y10T 16/287* (2015.01); *Y10T 16/304* (2015.01)

(58) Field of Classification Search
CPC ... E05B 15/022; E05B 17/0029; Y10T 16/27; Y10T 16/304
USPC ..... 292/340, 341.15–341.17, 71, 63, 64, 292/194, 195, 201, 198, 144
See application file for complete search history.

(56) References Cited

U.S. PATENT DOCUMENTS 3,521,921 A * 7/1970 Miyazaki ..... 292/201
3,640,560 A * 2/1972 Zawadzki et al. ..... 292/341.16
(Continued)

FOREIGN PATENT DOCUMENTS

DE 7730284 U1 1/1978
DE 2819334 A1 11/1979
(Continued)

OTHER PUBLICATIONS

International Search Report, PCT/EP2010/004703, dated Jan. 5, 2011.
(Continued)

*Primary Examiner* — Kristina Fulton
*Assistant Examiner* — Christine M Mills
(74) *Attorney, Agent, or Firm* — Lerner, David, Littenberg, Krumholz & Mentlik, LLP

(57) ABSTRACT

A door closing device for a door is described. The device includes an externally powered and/or spring force-powered catch device F for mounting to the stationary door frame TR or the door leaf TF. The catch device has a movably mounted catch element F and an externally powered and/or force storage means-powered drive assembly M connected to the catch element F. It is essential that the catch element F can be connected to and disconnected from the counterpart element, for example the lock latch S, so that the catch element F can be brought into engagement with the counterpart element S for pulling the door leaf TF shut and can be brought out of engagement with the counterpart element S outside of the pulling-shut movement.

21 Claims, 11 Drawing Sheets

(56) References Cited

U.S. PATENT DOCUMENTS

Figure 1:
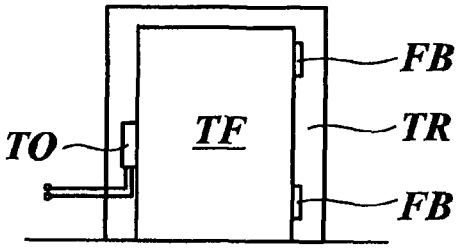

| | | | | |
|---|---|---|---|---|
| 4,015,869 | A * | 4/1977 | Horvath | 292/341.16 |
| 4,917,425 | A * | 4/1990 | Logas | 292/341.16 |
| 4,951,979 | A * | 8/1990 | Escaravage | 292/110 |
| 5,016,931 | A | 5/1991 | Jackson | |
| 5,118,150 | A * | 6/1992 | Jarrett | 292/341.16 |
| 5,474,342 | A * | 12/1995 | Smith et al. | 292/254 |
| 5,484,180 | A * | 1/1996 | Helmar | 292/341.16 |
| 5,490,699 | A * | 2/1996 | Uyeda | 292/341.16 |
| 5,492,382 | A * | 2/1996 | McBride et al. | 292/341.17 |
| 5,987,818 | A * | 11/1999 | Dabideen | 49/280 |
| 6,076,870 | A * | 6/2000 | Frolov | 292/341.16 |
| 6,216,980 | B1 * | 4/2001 | Baudu et al. | 244/110 B |
| 6,390,520 | B1 * | 5/2002 | Holzer | 292/341.17 |
| 6,685,242 | B2 * | 2/2004 | Furner | 292/341.16 |
| 6,874,830 | B2 * | 4/2005 | Bashford | 292/341.16 |
| 6,913,299 | B1 * | 7/2005 | Stendal | 292/341.15 |
| 6,926,318 | B2 * | 8/2005 | Oxley | 292/341.16 |
| 6,966,585 | B2 * | 11/2005 | Egi et al. | 292/341 |
| 7,021,684 | B2 * | 4/2006 | Orbeta et al. | 292/341.16 |
| 7,410,196 | B2 * | 8/2008 | Stein | 292/341.15 |
| 7,438,335 | B1 * | 10/2008 | Uyeda | 292/341.16 |
| 7,472,934 | B2 * | 1/2009 | Burke et al. | 292/341.16 |
| 8,047,585 | B1 * | 11/2011 | Peabody et al. | 292/341.16 |
| 8,096,594 | B2 * | 1/2012 | Uyeda | 292/341.15 |
| 8,544,895 | B2 * | 10/2013 | Webb et al. | 292/58 |
| 8,544,898 | B2 * | 10/2013 | Zimmer et al. | 292/137 |
| 8,659,176 | B2 * | 2/2014 | Hanchett, Jr. | 290/1 R |
| 8,720,959 | B2 * | 5/2014 | Wittke et al. | 292/341.15 |
| 8,851,537 | B2 * | 10/2014 | Ishii | 292/341.15 |
| 2006/0145488 | A1 * | 7/2006 | Wittke et al. | 292/341.15 |
| 2008/0042447 | A1 * | 2/2008 | Neumann | 292/126 |
| 2008/0136200 | A1 * | 6/2008 | Wittke | 292/341.16 |
| 2009/0033107 | A1 * | 2/2009 | Zimmer et al. | 292/302 |
| 2009/0072547 | A1 * | 3/2009 | Dirnberger et al. | 292/85 |
| 2013/0328332 | A1 * | 12/2013 | Scheffler et al. | 292/341.16 |

FOREIGN PATENT DOCUMENTS

| | | | |
|---|---|---|---|
| DE | 3401842 | A1 * | 8/1985 |
| DE | 19960809 | A1 | 6/2001 |
| DE | 20300385 | U1 | 3/2003 |
| DE | 202004014568 | U1 | 2/2006 |
| DE | 102006037494 | A1 | 2/2008 |
| DE | 102007044577 | A1 | 4/2009 |
| EP | 0757145 | A2 | 2/1997 |
| FR | 2549121 | A1 | 1/1985 |
| WO | 2007082524 | A1 | 7/2007 |
| WO | 2008083826 | A1 | 7/2008 |
| WO | 2008083836 | A1 | 7/2008 |
| WO | 2010/012497 | A1 | 2/2010 |

OTHER PUBLICATIONS

EPO Office Action for Appn. 10 740 552.4-1603 dated Apr. 14, 2015.

* cited by examiner

CLOSING DEVICE FOR A DOOR

CROSS-REFERENCE TO RELATED APPLICATIONS

The present application is a national phase entry under 35 U.S.C. §371 of International Application No. PCT/EP2010/004703, filed Jul. 31, 2010, published in German, which claims priority from German Application No. 10 2009 035 737.8 filed Aug. 1, 2009, all of which are incorporated herein by reference.

The invention concerns a door closing device for a door having a door leaf mounted movably on a stationary door frame.

Firstly some terminological definitions are set forth hereinafter:

The term 'door closing device' is used in the present application to denote a device which closes the door by way of a force storage means, for example a return spring, or an externally powered motor, for example an electric motor. The term 'door closing device' denotes not only a closing device for a door, but also a gate, a window and/or another closure device with a movably mounted leaf or casement. In other words the term 'door' in the present application also embraces a gate, a window and/or another closure device with a movably mounted leaf or casement.

The term 'door opener' or 'remotely actuable door opener' is used in the present application to denote a 'remotely actuable arresting device' for a door. The arresting device has a remotely actuable locking device and a door opener latch. The output-side locking member of the locking device directly or indirectly co-operates with the door opener latch and switches the door opener latch into a locking position and a release position. Locking position means that the door opener latch is blocked and the door can therefore not be opened. Release position means that it is released and the door can be opened.

Door opener means not just the opener of a door but also that of a gate, a window and/or another closure device with movably mounted leaf or casement. In other words the term door is used in the present application, as already stated above, to also embrace a gate, a window and/or another closure device with movably mounted leaf or casement. Door opener however does not mean that an assembly must be provided for driving the opening movement of the door; though such an assembly can be provided as an additional device.

The term leaf or door leaf is used in the present application to denote a rotary leaf and/or a sliding leaf comprising one or more such leaves. This may also involve a non-walkable, comparable closure device in the construction or furniture industry, thus for example it may also involve a smoke protection flap.

The term lock latch is used in the present application to denote the latch co-operating with the door opener latch. It is mounted resiliently. It does not have to be arranged in conjunction with a lock, but it can be.

As regards the state of the art:

Door closers are known, which are in the form of so-called spring hinge bands (DE 203 00 385 U1, GM 77 30 284). This involves hinge bands with which the door leaves are mounted rotatably to the door frame. Integrated in the bands is a mechanical return spring which is tensioned upon opening of the door and which gives off energy to close the door, that is to say the door closes automatically under the action of the return force of the spring. A disadvantage with those spring hinge bands is that relatively strong springs are required to ensure complete closure of the door. It is particularly critical if a lock latch or a seal has to be overridden to close the door. It happens with the strong springs that the door, upon closing, slams shut more or less loudly. In addition upon opening that involves a relatively high resistance to opening movement for the user who is manually opening the door.

Hydraulic door closers are known in which a closer spring, a hydraulic damping device and a closer shaft are mounted in a door closer housing (DE 28 19 334 A1). The door closer housing is mounted to the door leaf or the door frame. A force-transmitting linkage coupled to the closer shaft is to be fixed with its free end to the door frame or the door leaf. Such hydraulic door closers permit a damped closing movement of the door over the entire door opening range into the closed position. A disadvantage however is the relatively high resistance to opening movement for the user who is manually opening the door. In addition, that configuration involves visual disadvantages in regard to surface-mounted fitment of the door closer housing. Hydraulic door closers for concealed internally disposed mounting, that is to say in the door leaf and in the door frame, are admittedly also known. Those designs however involve particularly complicated and expensive mounting and special structural conditions are required.

The object of the invention is to provide a door closing device of the kind set forth in the opening part of this specification, which ensures reliable closure of the door in the closed final position and which has user and/or mounting advantages.

That object is attained with the subject-matter of claim 1. This involves a door closing device for a door having a door leaf mounted movably to a stationary door frame, wherein the door closing device has an externally powered and/or spring force-powered catch device and a counterpart element co-operating with the catch device for pulling the door leaf shut. The catch device is intended for mounting to the stationary door frame. The counterpart element is intended for mounting to the door leaf. It is essential that the catch device has a catch element which is mounted movably and/or which is adapted to be movable and an externally powered and/or force storage means-powered drive assembly which is connected to the catch element, and the catch element can be connected to and disconnected from the counterpart element so that it can be brought into engagement with the counterpart element for pulling the door leaf shut and can be brought out of engagement with the counterpart element outside the door closing situation. It is essential in that respect that the counterpart element is in the form of a lock latch which can be overridden upon closure of the door and which is mounted on a spring and which has an inclined portion coming into operation in the closure movement. When the door is closed the lock latch is overridden against the spring force. Thereafter the lock latch is extended again under the force of the spring. In the closed position of the door the lock latch, with its blocking side remote from the inclined portion, co-operates with a frame-side abutment to hold the door in the closed position.

It is essential in this solution therefore that the drivable catch element can be connected to and disconnected from the counterpart element during operation. In the closure movement the catch element is in engagement with the counterpart element in the form of the lock latch, that is to say it is coupled to the counterpart element in the form of the lock latch, only in a door opening range immediately prior to the closed position of the door. That door opening range is the pulling-shut range, that is to say the range in which the door is pulled into the closed position under the action of the driven catch element. In the opening movement the catch element is out of engagement in respect of the counterpart element, that is to say the catch element and the counterpart element are uncoupled from each other, at least as from a door opening range which is greater than the pulling-shut range. The uncoupling process can already occur in the closed position of the door or it is effected in a region between the closed position and a door opening range in which coupling takes place in the closing movement.

It is provided in preferred embodiments that the catch element is of such a configuration and/or is so mounted that it can perform a maximum adjusting travel which is at Y-times the door leaf thickness, wherein Y is of a value of between 2 and 0.5, preferably a value of between 1.5 and 1, and is particularly preferably a value around 1.2. With these embodiments the adjusting travel can be particularly well adapted to the gap width in the open position of the door, in which coupling thereto takes place.

Further preferred embodiments provide that the catch element is so adapted and/or is so mounted that it can perform a maximum adjusting travel of X mm, wherein X is a value of between 2 and 20, preferably a value of between 5 and 15, and in particular is a value of 10.

In preferred embodiments it is provided that the catch element can be moved out and in perpendicularly to the door frame opening plane. The catch element can be mounted rotatably and/or linearly displaceably. Preferably the catch portion of the catch element is provided at the free end of the catch element. The catch element can be adapted to be moved out and in and in its extended position can be brought into engagement with the counterpart element.

In that respect there are provided embodiments in which the catch element is mounted pivotably about an axis of rotation and the catch element is arranged on a frame member of the door frame in such a way that the axis of rotation of the catch element is arranged parallel to the door frame opening plane and perpendicularly to or parallel to the longitudinal extent of the frame member of the door frame or door leaf. With these embodiments the catch element, in its outwardly pivoted position, can come into the engagement position with the counterpart element in particularly operationally reliable fashion.

There are also embodiments in which the movement of the catch element is composed of a rotary movement and a linear movement. Preferably this involves design configurations in which the catch element on the one hand is pivotable about an axis of rotation arranged parallel to the door frame opening plane and on the other hand is linearly displaceable in a plane of movement which is arranged perpendicularly to the door opening plane. In that way the catch element enjoys particularly many degrees of freedom in respect of its movement.

Particularly high operational reliability is achieved with constructions in which it is provided that the catch element is mounted rotatably about an axis of rotation and has a plurality of prongs which are oriented substantially radially relative to the axis of rotation and which are of different lengths such that the prong which comes into engagement first with the counterpart element in the closing movement is shorter than the prong which thereafter comes into engagement with the counterpart element upon further closing movement of the door. It is structurally particularly simple if the catch element is mounted rotatably about an axis of rotation and is of a substantially sickle-shaped configuration.

In addition configurations are also possible in which the catch element is formed from a plurality of sub-elements which are arranged at a spacing relative to each other and which are movable in mutually opposite relationship and which are arranged in the closed position of the door on both sides of the counterpart element. Preferred developments provide that the sub-elements are respectively in the form of rotatable catch elements or the sub-elements are respectively in the form of linearly displaceable catch elements.

Enhanced operational reliability in the coupling phase is achieved with design configurations in which the catch element has an inclined portion with which the catch element comes into contact at the counterpart element when pulling the door shut. It is further provided in preferred embodiments that the catch device has a switch device which can actuate the motor assembly and which comes into operative relationship with the counterpart element upon closure of the door before the catch element comes into engagement with the counterpart element. It is particularly advantageous in that connection if the catch element has a plurality of prongs and the switch device has a switch element arranged between two prongs.

An essential aspect in the solution according to the invention is that the catch device is externally powered and/or spring force-powered. In preferred embodiments, there is a drive assembly with an electric motor assembly for externally powered actuation. The electric motor assembly can be in the form of an electromechanical motor, preferably in the form of an electric rotational motor with drive output shaft which can be coupled to the catch element. Alternatively the electric motor assembly can also be in the form of an electrohydraulic motor, preferably an electrohydraulic pump which is connected in a hydraulic circuit by which the catch element is drivable.

In particularly preferred embodiments it can be provided that the drive assembly has a ratchet switching transmission controllable with an electric motor assembly and/or an electric solenoid assembly. The ratchet switching transmission can be both in the form of an active motor drive and also in the form of a pure locking device.

Embodiments are also possible in which it is provided that the drive assembly is in the form of a pneumatic motor assembly.

Instead of or in addition to the electric motor assembly however the drive assembly can also have a force storage means assembly, preferably a spring storage means assembly. The spring storage means assembly can be in the form of a return spring which can be positively acted upon when the door is opened. The energy for pulling the door shut is then afforded upon closure of the door under the action of the return force of the return spring.

Embodiments are possible in which the drive assembly has a locking device co-operating directly or indirectly with the catch device in such a way that the catch device can be switched into a locking position and a release position. In that case the drive assembly functions like the locking device of a remotely actuable door opener. The term remotely actuable door opener is to be interpreted in the present application as meaning a remotely actuable arresting device for a door. The arresting device has a remotely actuable locking device and a door opener latch. The output drive-side locking member of the locking device co-operates directly or indirectly with the door opener latch, it can possibly also be in one piece with the door opener latch, and it switches the door opener latch into a locking position and a release position. Locking position means that the door opener latch is blocked so that the door cannot be opened. Release position means that the door opener latch is released so that the door can be opened.

Embodiments of the door closing device are also possible in which a door opener is integrated in the door closing device or in which a door opener is used as the door closing device, the door opener functioning as a door closing device insofar as the catch device is formed by the door opener latch and same as the catch element co-operates with the counterpart element and pulls the door shut in the pulling-shut range in externally powered fashion and/or in spring force powered fashion. In preferred embodiments the locking device can be formed by the drive device of the catch element insofar as locking is effected by the self-locking action of the drive assembly. The drivable door opener latch can serve not only for fixing the door in the closed position but also for pulling the door shut and/or for self-adjustment of the door opener latch. Self-adjustment of the door opener latch involves an automatic adjusting movement in order to put the door opener latch in the position of bearing against the closing latch so that in the closed position of the door, the door opener latch bears rattle-free against the lock latch.

In particularly preferred embodiments it is provided that in addition to the catch device the door closing device has a door closer which can be permanently coupled to the door leaf and the stationary door frame over the entire door opening range. The permanently coupleable door closer can be in the form of a conventional door closer. It is intended primarily to serve to close the door from any angle of opening, more specifically to as closely as possible to the closed position. The driven catch device serves for reliably pulling the door shut into the closed position, which catch device is coupled to the counterpart element for the pulling-shut operation and moves the door into the completely closed position in externally powered fashion and/or in spring force-powered fashion.

The door closer is permanently coupled in the installation position, that is to say it is permanently operatively connected between the stationary door frame and the door leaf. The door closer can be in the form of a spring hinge band. The spring hinge band can have a mechanical closer spring which is arranged in the region of the axis of rotation of the spring hinge band and which is preferably integrated therein. Alternatively the door closer can also be in the form of a door closer mounted to the door leaf or the stationary frame in surface-mounted relationship or in internally disposed relationship, or can also be in the form of a floor door closer. It can have a closer housing with a closer shaft and closer spring mounted therein, optionally with hydraulic damping. The closer shaft can be permanently coupled directly or by way of a force-transmitting linkage to the door frame.

It is essential in all embodiments according to the invention that the configuration of the catch device is such that reliable coupling to and uncoupling from the catch element is made possible. In preferred embodiments the catch element engages with its free end behind the counterpart element in positively locking relationship. The counterpart element can be mounted rigidly or movably.

In preferred embodiments the counterpart element can be in the form of a mushroom-shaped closure bolt, preferably in the form of a rigidly mounted counterpart element.

Particularly advantageous co-operation of the catch element with the counterpart element which is in the form of the lock latch is afforded in embodiments in which the catch element is in the manner of a door opener latch, preferably a pivotable door opener latch or a linearly displaceable door opener latch.

In particularly preferred embodiments the door opener latch is formed by a mounting body and a latch body movable relative thereto. The latch body can be mounted displaceably on the mounting body and can be fixed on the mounting body by means of an arresting device actuable by way of the lock latch. For driving and/or fixing the mounting body of that door opener latch the drive output member of the drive or locking device can act on the latch body for example by way of a surface portion.

Figure 2A:
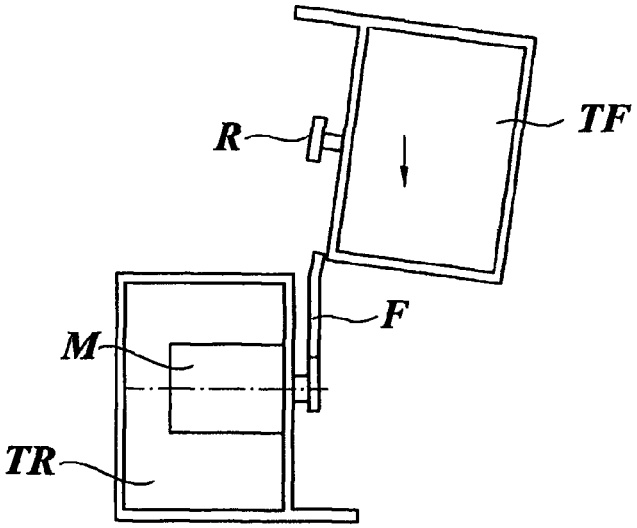
Figure 2A:
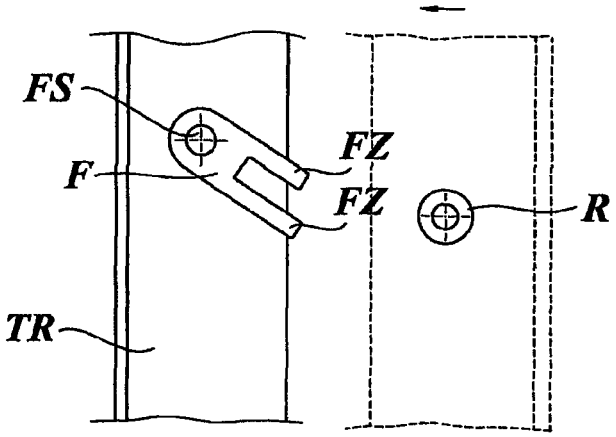
Figure 2B:
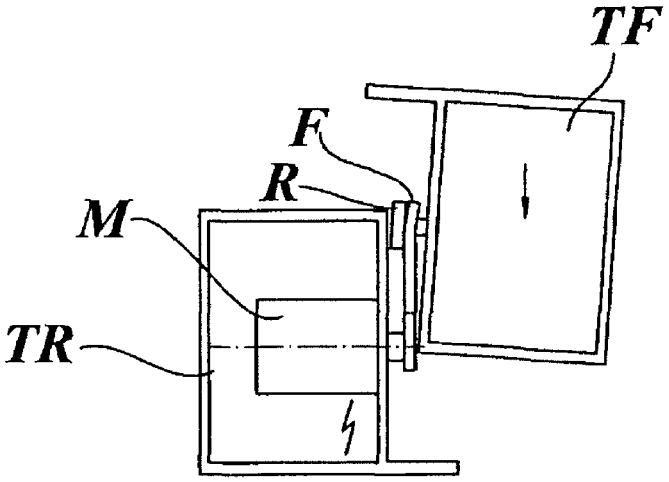
Figure 2B:
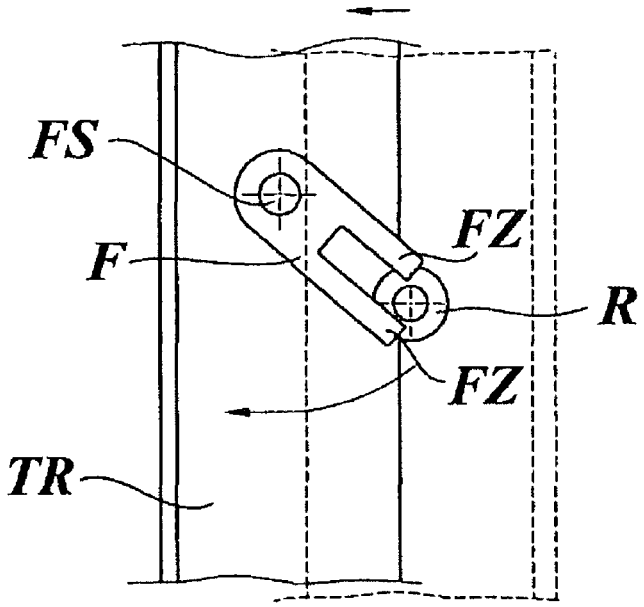
Figure 2C:
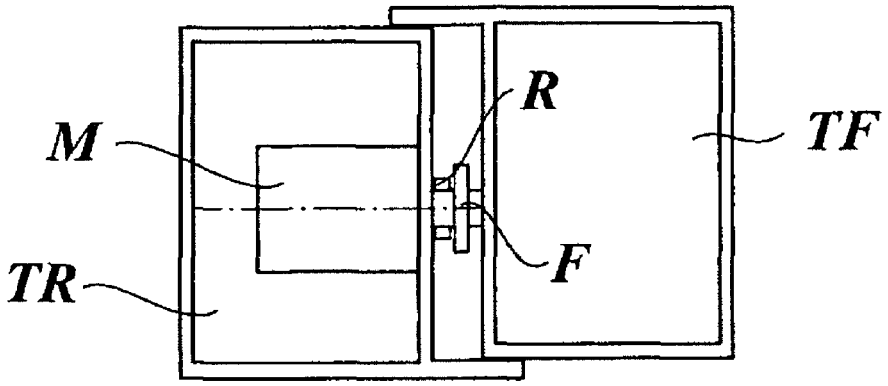
Figure 2C:
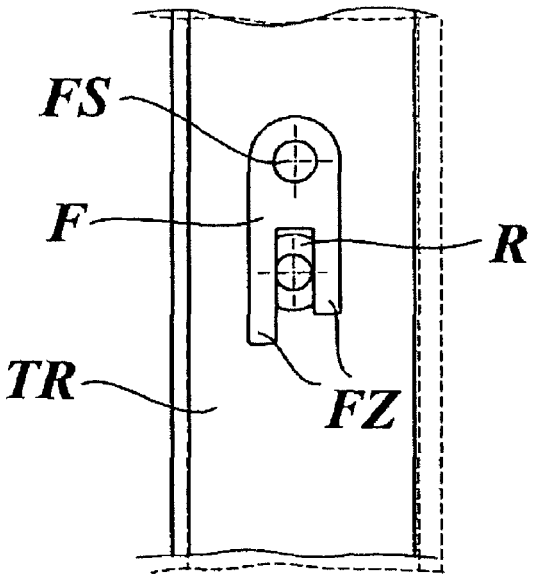
Figure 3A:
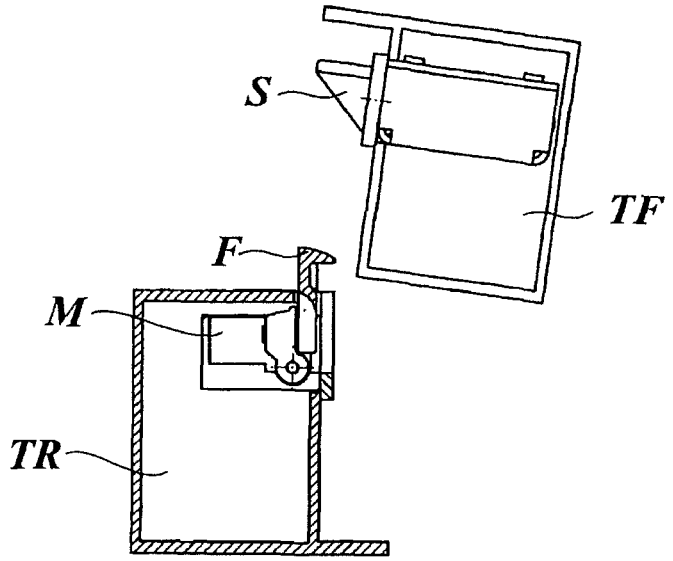
Figure 3B:
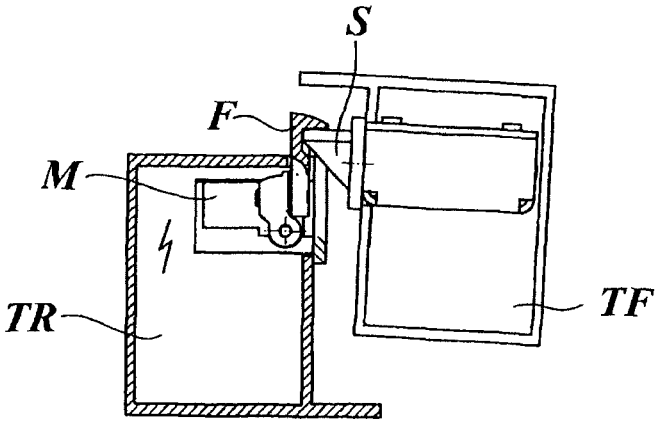
Figure 3C:
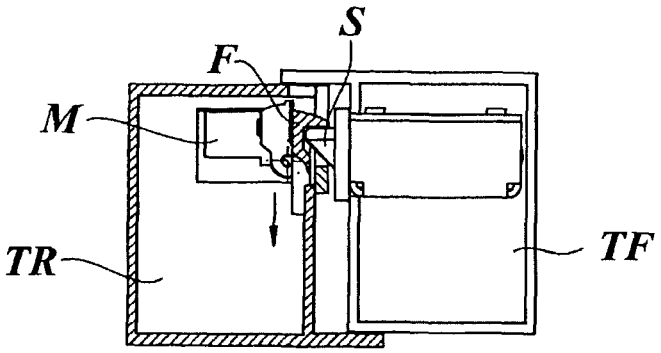
Figure 4A:
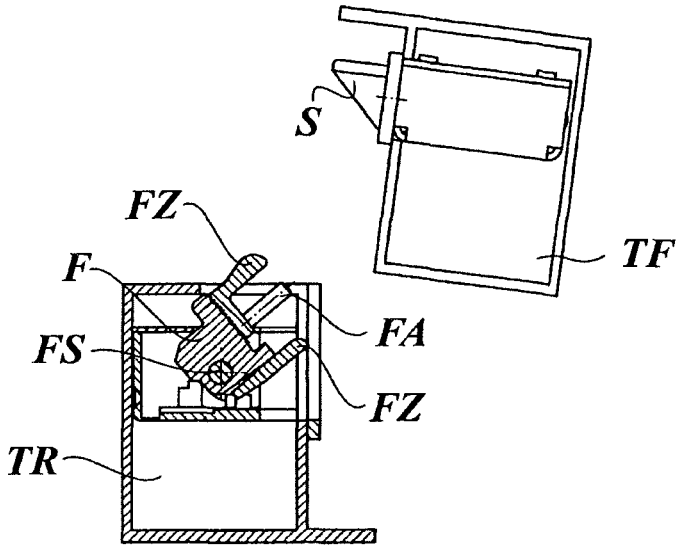
Figure 4B:
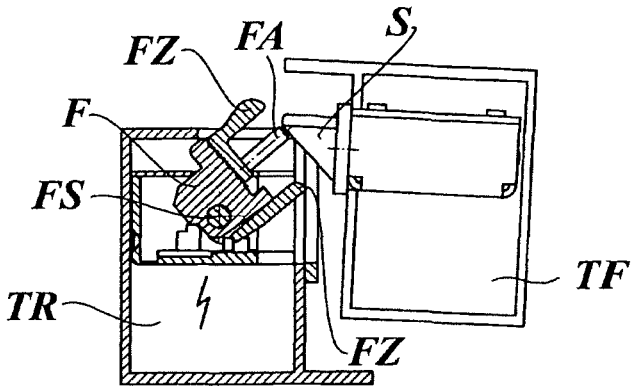
Figure 4C:
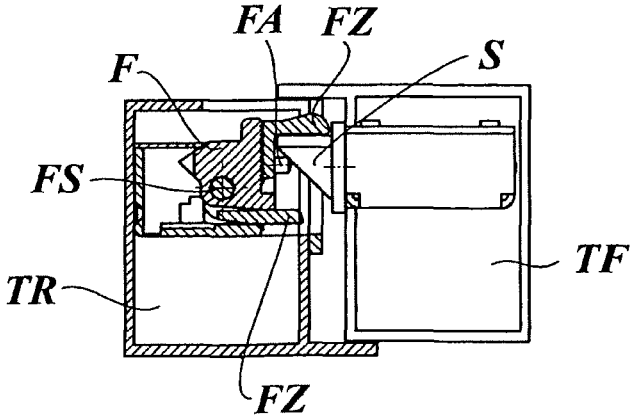
Figure 5:
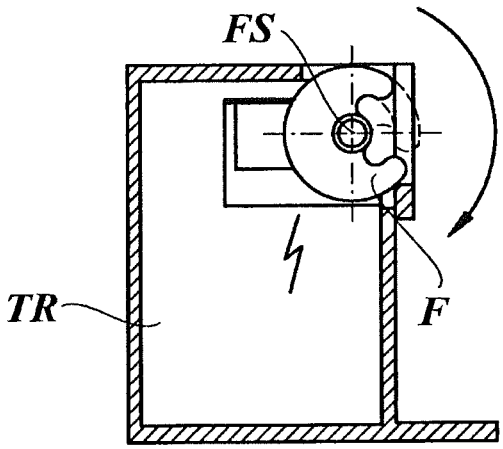
Figure 6:
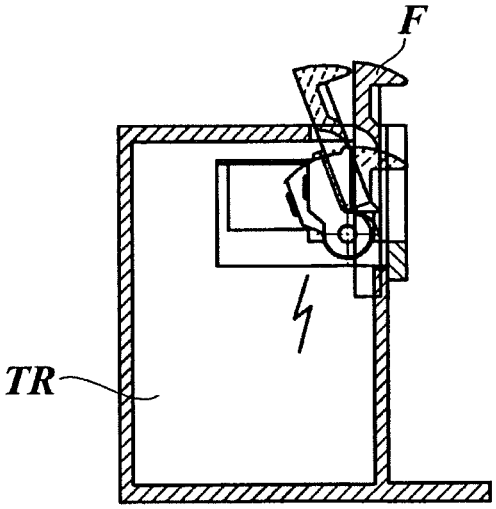
Figure 7A:
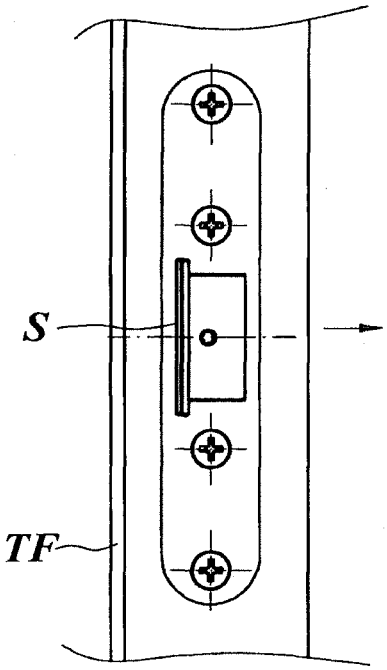
Figure 7B:
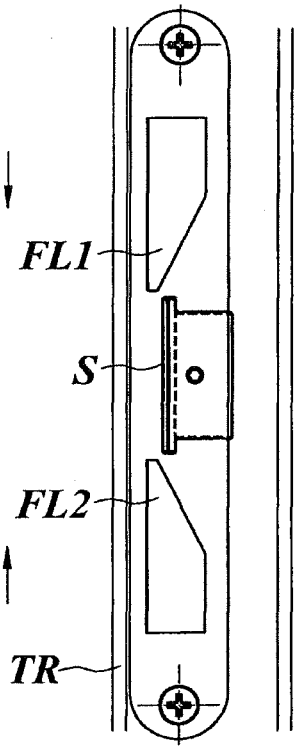
Figure 7C:
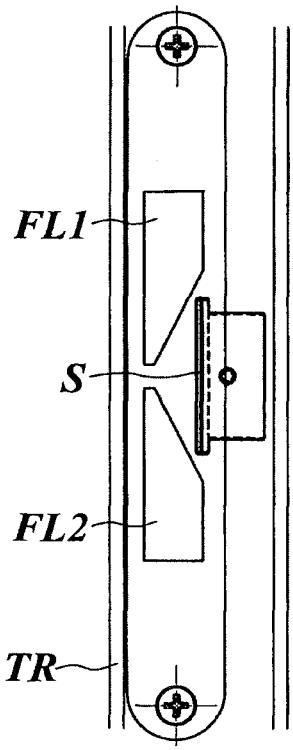
Figure 8A:
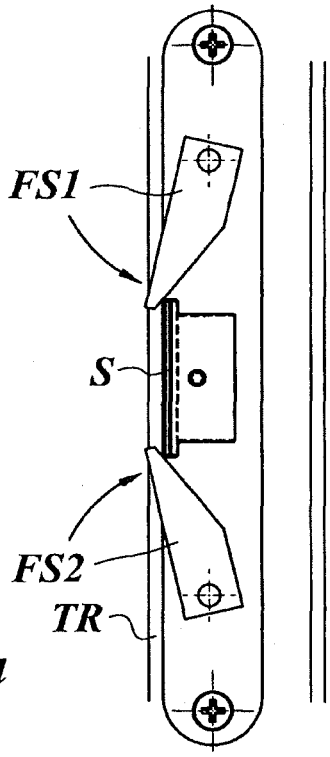
Figure 8B:
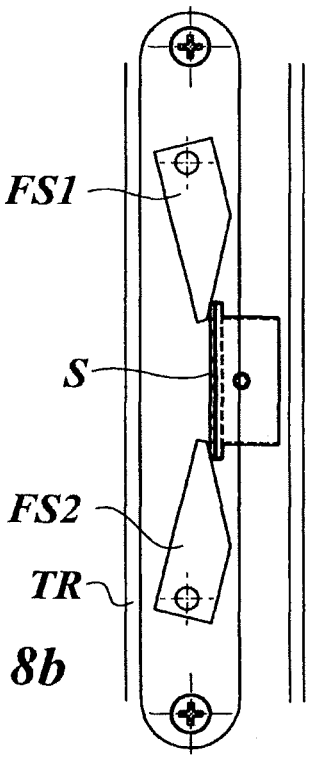
Figure 11:
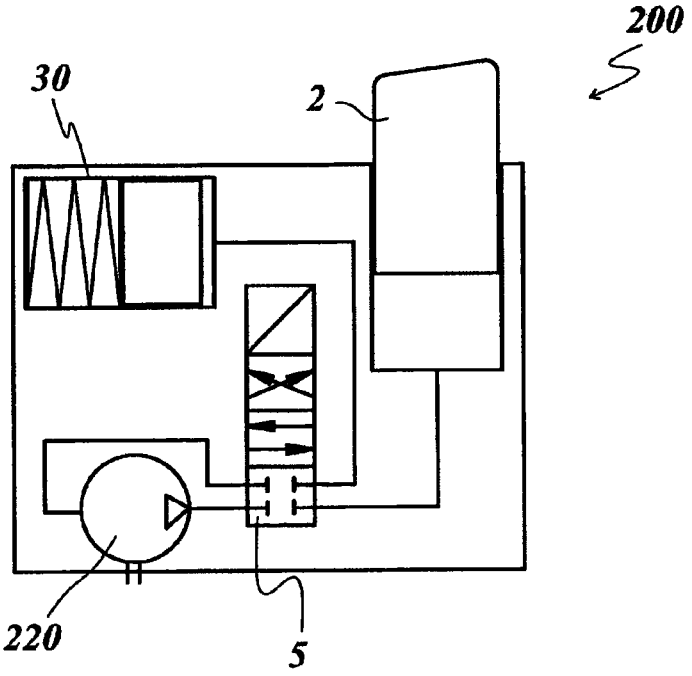

The invention will now be described in greater detail by means of embodiments by way of example. In the drawing:

FIG. 1 shows a diagrammatic view of an example of installation of a door opener, FIGS. 2*aa* and 2*ab* show an embodiment of a door closing device in a first closing position, FIGS. 2*ba* and 2*bb* show the door closing device of FIGS. 2*aa* and 2*ab* in a second closing position, FIGS. 2*ca* and 2*cb* show the door closing device of FIGS. 2*aa* and 2*ab* in a third closing position, FIG. 3*a* shows an embodiment of a door closing device in a first closing position, FIG. 3*b* shows the door closing device of FIG. 3*a* in a second closing position, FIG. 3*c* shows the door closing device of FIG. 3*a* in a third closing position, FIG. 4*a* shows a further embodiment of the door closing device according to the invention in a first closing position, FIG. 4*b* shows the door closing device of FIG. 4*a* in a second closing position, FIG. 4*c* shows the door closing device of FIG. 4*a* in a third closing position, FIG. 5 shows a further embodiment of the door closing device according to the invention, FIG. 6 shows a further embodiment of the door closing device according to the invention, FIGS. 7*a* through 7*c* shows a further embodiment of the door closing device according to the invention, FIGS. 8*a* and 8*b* shows a further embodiment of the door closing device according to the invention, FIGS. 9*a* through 9*d* shows a further embodiment of the door closing device according to the invention, FIGS. 10*a* through 10*d* shows a further embodiment of the door closing device according to the invention, FIG. 11 shows a first embodiment of the adjusting device in FIGS. 9*a* through 10*d*, FIG. 12 shows a second embodiment of the adjusting device in FIGS. 9*a* through 10*d*, and FIG. 13 shows a third embodiment of the adjusting device in FIGS. 9*a* through 10*d*.

FIG. 1 shows an example of installation of an embodiment of the closing device according to the invention. Installation is on a door having a door leaf TF mounted to a stationary door frame TR rotatably about a vertical axis of rotation.

The closing device according to the invention in the example of installation is composed of two closing components. The one closing component is formed by two spring hinge bands FB by way of which the door leaf TF is mounted about its vertical axis of rotation. The other closing component is formed by a special door opener TO. That door opener has an electrically powered motor closing assembly which engages the door leaf shortly before the closed position of the door by means of a driven-side catch element and pulls it shut into the closed position by motor means.

The spring hinge bands FB used are per se known commercially available spring hinge bands. They each have a respective spring assembly which is integrated into the bands and which is positively loaded up when the door is opened and delivers the stored energy again when the door is closed to drive the door leaf automatically in the closing movement. Such spring hinge bands are known for example from DE 203 00 385 U1 and GM 77 30 284.

Instead of the spring hinge bands it is also possible to use another closing means, for example a per se known hydraulic door closer with closing spring, hydraulic damping and force-transmitting linkage. Such a door closer is known for example from DE 28 19 334 A1.

A substantial advantage with this novel system is that the first closing component can in each case be in the form of a very simple closing assembly which preferably has only a slight resistance to opening and which only has to be designed to provide that the door is returned from the open position into the proximity of the closed position. The fact of the door being subsequently pulled shut into the closed position, possibly while overriding a lock latch and overcoming a door seal, is ensured by the second closing component, in the illustrated case by the motor pulling-shut assembly of the door opener TO. Embodiments are also possible in which the pulling-shut assembly is not connected to a door opener but is in the form of a separate closer assembly without a door opener function. A separate door opener can be provided at any event, but does not have to be.

FIGS. 2 through 13 show various embodiments of that second closing component, that is to say embodiments of the pulling-shut assembly. Those pulling-shut assemblies can at the same time also have a door opener function, that is to say they can themselves function as a door opener, more specifically if the motor-powered catch element F can be fixed in a locking position in the closed position of the door, which can possibly be implemented by the self-locking action of the motor drive assembly. The embodiments of FIGS. 3 through 13 involve embodiments according to the invention. In those the counterpart element R at the door leaf side is in the form of a resiliently mounted door opener latch which can be overridden.

In the embodiment in FIGS. 2*aa* through 2*c* the leaf-side counterpart element R is in the form of a rigid mushroom. FIGS. 2*aa* through 2*cb* serve only for better understanding of the pulling-shut assembly in conjunction with the door positions when pulling the door shut, being positions through which the door also passes with the embodiments according to the invention. FIGS. 2*aa* through 2*cb* show the embodiment of the pulling-shut assembly in different door positions, each showing a diagrammatic view in section and a diagrammatic side view.

FIG. 2*aa* and tab show a first embodiment in which a catch element F rotatable about an axis of rotation FS is arranged in the door frame TR and co-operates with a counterpart element R arranged on the door leaf TF. The catch element F which is in the form of a flat pivotal arm is mounted rotatably about an axis of rotation FS at its mounting end and at its free end has two parallel prongs FZ. The prongs FZ extend in the longitudinal direction of the pivotal arm and are oriented substantially radially relative to the axis of rotation FS. They are of differing lengths, more specifically in such a way that the prong FS which first comes into engagement with the counterpart element R in the closing movement is shorter than the prong FZ which comes into engagement thereafter with the counterpart element R in the further closing movement of the door. The catch element F is non-rotatably connected to the drive output shaft of a motor assembly M and is driven in rotation in that way.

The counterpart element R is rigidly immovably mounted to the door leaf TF. It is in the form of a mushroom closure bolt. The bolt is in the form of a cylindrical peg and the mushroom head is in the form of a flat disk. In that case the diameter of the peg is smaller and the diameter of the disk is larger than the internal spacing between the two prongs FZ.

In the door position shown in FIG. 2*aa* and tab the door leaf TF is shortly before bearing against the door frame TR. The catch element F assumes such a rotational position that the peg of the counterpart element R can engage between the two prongs FZ of the catch element F. There is not yet any engagement between the catch element F and the counterpart element R.

In the door position shown in FIGS. 2*ba* and 2*bb* the door leaf TF has closed by a few degrees of angle further. The counterpart element R is just coming into engagement with the catch element F and is passing between the prongs FZ of the catch element F. In this case the peg of the counterpart element R initially bears against the inside of the longer prong FZ. It passes over the shorter prong FZ. At the same time the motor assembly M is switched on, which now causes the catch element F to rotate. The motor assembly M now acts as an aid for pulling the door shut. The door leaf TF is further closed with the driven pivotal movement of the catch element F which is in engagement with the counterpart element. In the course of the pivotal movement of the catch element the inside of the shorter prong also comes to bear against the peg of the counterpart element R. Upon further rotation the peg further engages into the space between the two prongs of the catch element F and in so doing entrains the door leaf TF which is moved in that way into an end closing position as shown in FIGS. 2*ca* and 2*cb*.

In the end closing position the door leaf TF bears firmly against the door frame TR.

The motor assembly M can preferably be an electric motor. The rotary movement of the motor assembly M can also be triggered by an electric contact which can be formed for example by the counterpart element R and the catch element F. A suitable switch device can be provided, for example arranged between the prongs FZ. It is however also possible to provide a switch which is arranged on the door frame TR and is actuated directly by the door leaf TF. The motor assembly M can be switched off for example by an excess-current switch or a limit switch when the situation involves an electric motor. It can also be provided that the motor assembly is an electric geared motor, wherein the transmission gear can preferably involve a step-down transmission which reduces the speed of rotation of the rotor.

The second embodiment shown in FIGS. 3*a* through 3*c* involves a catch element F which is mounted linearly movably to the door frame, more specifically being linearly movable parallel to the longitudinal extent of the frame member of the door frame TR. The catch element F is connected to the drive output of the motor assembly M. At its free end it has a hook-shaped end portion, wherein the hook claw is arranged perpendicularly to the frame member of the door frame TR and projects out of the plane of opening movement of the door frame TR when the door leaf TF is opened. The counterpart element is in the form of a lock latch S which can be overridden when the door leaf TF is closed. The lock latch S is mounted on a spring in a housing mounted in the frame member of the door leaf TF and has an inclined portion which comes into operation upon closure of the door leaf TF. The catch element F has a rounded inclined portion which co-operates with the inclined portion of the lock latch S upon closure of the door leaf TF.

Upon closure of the door leaf TF (FIG. 3*a*) the inclined portions of the catch element F and the lock latch S slide against each other, in which case the spring-loaded lock latch S deflects back into the lock and finally engages under the hook claw of the catch element F (FIG. 3*b*). The hook claw of the catch element F is now pulled in linearly relative to the door frame TR by actuation of the motor assembly M and in so doing entrains the lock latch S together with the door leaf TF whereby the door leaf TF finally comes to bear against the door frame TR (FIG. 3*c*) and thus the door is set in the closed position.

Switch devices (not shown) can be provided for actuation of the motor assembly M. They can be designed for example like the switch arrangements described hereinbefore with reference to FIGS. 2*aa* through 2*cb*.

FIGS. 4*a* through 4*c* show a third embodiment of the door closing device. The catch element F is mounted pivotably about an axis of rotation FS parallel to the longitudinal extent of the frame member of the door frame TR and is rotationally rigidly connected to the drive output of a motor assembly. The motor assembly is not shown in FIGS. 4*a* through 4*c* but can be of a corresponding design configuration to the motor assembly M in the embodiment of FIG. 1. In this embodiment the catch element F is arranged in a recess in the frame member of the door frame TR. The catch element F is designed in the manner of a pivotal latch of a door opener. At its end portion remote from the axis of rotation FS it has two prongs FZ, wherein the prong FZ which is towards the frame member of the door frame TR projects out of the frame member of the door frame TR, that is to say out of the recess in the door frame TR, when the door leaf is opened. The other prong FZ is shorter. Arranged between the two prongs FZ is a trigger device FA which actuates the motor assembly M. When the door leaf TF is closed the lock latch S passes into the recess in the door frame TR and in so doing actuates the trigger device FA (FIG. 4*b*). The catch element F is now rotated, in which case the prong FZ towards the frame member of the door frame TR engages over the lock latch S and entrains it and thus causes the door leaf TF to come to bear against the door frame TR (FIG. 4*c*).

FIG. 5 shows a fourth embodiment of the door closing device. The catch element F is of a substantially sickle-shaped configuration, that is to say in the form of a circular disk with a peripheral recess. Comparably to the catch element F in FIG. 4 the catch element F in FIG. 5 is also mounted pivotably about an axis of rotation FS parallel to the longitudinal extent of the frame member of the door frame TR and is rotationally rigidly connected to the drive output of a motor assembly (not shown). Upon closure of the door leaf (not shown in FIG. 5) the lock latch engages into the peripheral recess in the catch element F and, when the catch element F rotates, has a hook-shaped portion of the catch element F engaging thereover so that it is entrained. The design configuration shown in FIG. 5 is distinguished by being of a particularly simple structure.

FIG. 6 shows a fifth embodiment of the door closing device. In this case the catch element F is of such a configuration that on the one hand it is pivotable about an axis of rotation FS arranged parallel to the door opening plane while on the other hand it is linearly displaceable in a plane of movement arranged perpendicularly to the door opening plane. The catch element F is non-rotatably connected to the drive output of a motor assembly (not shown in FIG. 6). The catch element F and the motor assembly M are arranged in a mounting recess in the frame member of the door frame TR. The catch element F has a hook-shaped end portion, wherein the hook claw is disposed perpendicularly to the frame member of the door frame TR and projects out of the surface of the door frame TR, that is to say out of the mounting recess, in the opened condition of the door leaf TF (not shown in FIG. 6). In the open position of the door the catch element F is in an inclined position so that the hook-shaped end portion is outside the movement of the lock latch.

When the door leaf is closed the motor assembly M is firstly powered. The catch element F is pivoted out of its inclined position under the action of the motor assembly M to such an extent that it assumes a position in the path of movement of the lock latch. From that position the catch element F is linearly displaceable in a plane of movement perpendicularly to the door opening plane. When the door is being closed the catch element F and the lock latch S assume the engagement position by virtue of the catch element F in its pivotal movement engaging over the lock latch (not shown in FIG. 6), with its hooked end portion. In its linear displacement the catch element F then entrains the lock latch together with the door leaf until the door leaf bears against the door frame and the door is thus in the closed position.

FIGS. 7*a* through 7*c* show a sixth embodiment of the door closing device in which the catch element is formed from two sub-elements FL1 and FL2 which are arranged at a mutual spacing and are movable in mutually opposite relationship. They are mounted to the door frame TR in such a way that in the closed position of the door (FIG. 7*a*) they are arranged on both sides of the lock latch S at the door leaf side.

The two sub-elements FL1 and FL2 are movable linearly towards each other and each have an inclined portion which, when the door leaf TF is being closed, come to bear against the lock latch S and entrain it and thus pull the door leaf TF shut. A force boosting effect can occur similarly to the force conditions on a wedge, at the two inclined portions, so that the motor assembly (not shown in FIGS. 7*a* through 7*c*) only has to provide a comparatively low force to generate a high closing force at the door leaf TF.

FIGS. 8*a* and 8*b* show a seventh embodiment of the door closing device. It differs from the example shown in FIGS. 7*a* through 7*c* only in that, instead of linearly movable sub-elements, it has pivotable sub-elements FS1 and FS2 which are mounted rotatably. They come into engagement with the lock latch S at the door leaf side when the door is being closed and in the driven rotary movement thereof entrain the lock latch S. That provides that the door leaf TF is pulled shut and the door is in the closed position.

FIGS. 9*a* through 9*d* show an eighth embodiment.

The door closing device is integrated in a door opener. The door opener latch 1 of the door opener is of a special configuration for that purpose. It is described in greater detail hereinafter with reference to FIGS. 9*a* through 9*d*. The door opener latch 1 co-operates with a drive output member 2 of an adjusting device 200. The adjusting device 200 functions as a motor assembly for pulling the door leaf shut. In addition the adjusting device 200 also forms the locking device of the door opener, by way of which the door opener latch 1 can be arrested in the closed position of the door. The adjusting device 200 is described in greater detail hereinafter with reference to FIGS. 11 through 13.

The structural unit comprising the door opener latch 1 and the adjusting device 200 is arranged in a common housing 6. The door opener latch 1 has a pivotably mounted mounting body 110 with a pivot axis 110*s*, the mounting body 110 being embraced by a displaceable latch body 10. The latch body 10 has a through hole which for example as in the embodiment shown in FIGS. 9*a* through 9*d* can be of a rectangular cross-section and can have the mounting body 110 passing therethrough. At its end portion remote from the pivot axis 110*s* the latch body 10 has a hook entrainment portion 10*m* which faces upwardly and co-operates with a lock latch 90 of a door leaf (not shown in FIGS. 9*a* through 9*d*).

Arranged on the displaceable latch body 10 is a pivotably mounted arresting lever 10*h*, wherein the arresting lever 10*h* is arranged on the side of the latch body 10, that is towards the door leaf, and the pivot axis of the arresting lever 10*h* is oriented parallel to the pivot axis 110*s* of the mounting body 110. A first end portion of the arresting lever 10*h* is in the form of an abutment end 10*a* and co-operates with the lock latch 90. A second end portion of the arresting lever 10*h* is in the form of an arresting engagement end 10*e* and co-operates with sawtooth-shaped latching recesses on the latch body 10. In a portion between the abutment end 10*a* and the pivot axis of the arresting lever 10*h*, disposed between the arresting lever 10*h* and the latch body 10 is a compression spring 10*r* which urges the arresting engagement end 10*e* on to the latch body 10. The arresting engagement end 10*e* can slide along an arcuate release abutment 10*f* when it is no longer in engagement with the sawtooth-shaped latching recesses.

Provided on the underside of the latch body 10, that is remote from the door leaf, is a wedge surface 10*k* co-operating with the drive output member 2 of the adjusting device 200.

Figure 9A:
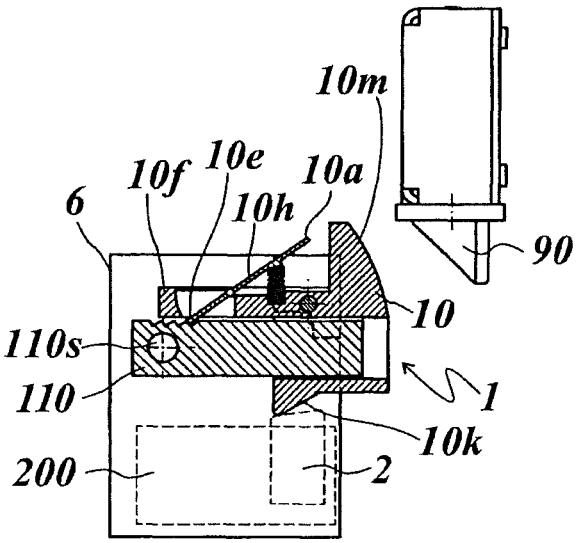

FIG. 9*a* now shows the device in a first position in which the lock latch 90 has not yet come to bear against the wedge surface K of the entrainment portion 10*m* of the latch body 10. The latch body 10 is arrested on the mounting body 110 because the arresting engagement end 10*e* of the arresting lever 10*h* engages into one of the sawtooth-shaped latching recesses in the mounting body 110.

Figure 9B:
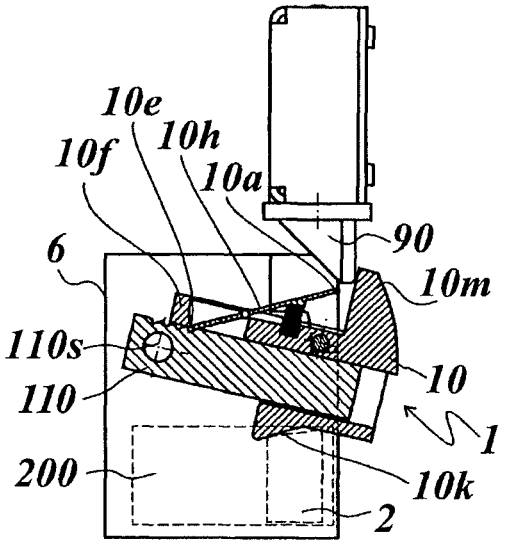

When the door leaf is closed (see FIG. 9*b*) the lock latch 90 comes into contact with the entrainment portion 10*m* and thus triggers the drive of the adjusting device 200 by way of a switch device (not shown in FIGS. 9*a* through 9*d*), whereby the drive output member 2 moves back into the adjusting device 200 and the door opener latch 1 is pivoted into the closing position shown in FIG. 9*b*. It can be provided in that respect that the lock latch 90 is overridden before it drops behind the entrainment portion 10*m*, as shown in FIG. 9*b*. The door opener latch 1 is only pivoted to such an extent that the lock latch 90, in that position of the door leaf, is still at a small spacing relative to the top side of the abutment end 10*a* of the arresting lever 10*h*.

Figure 9C:
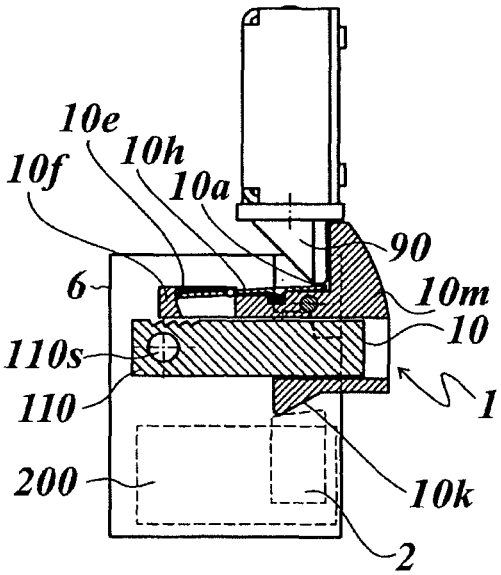
Figure 9D:
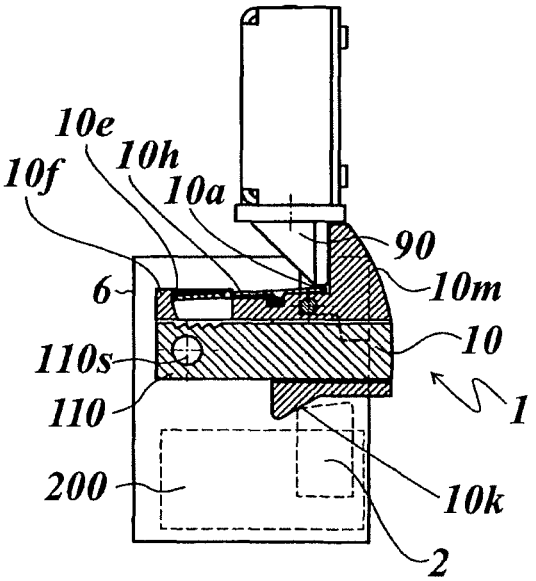
Figure 10A:
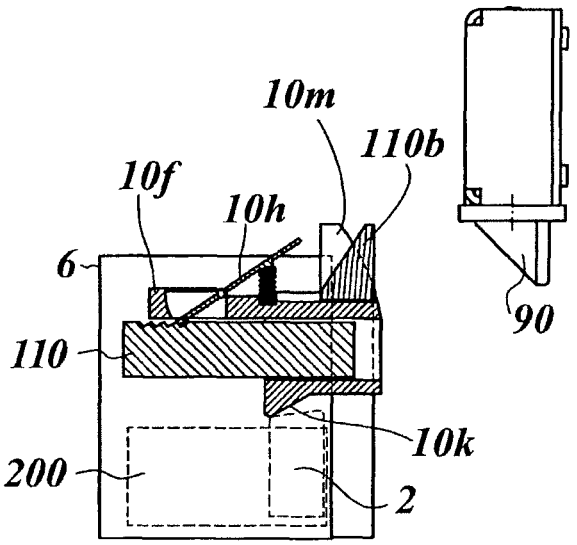
Figure 10B:
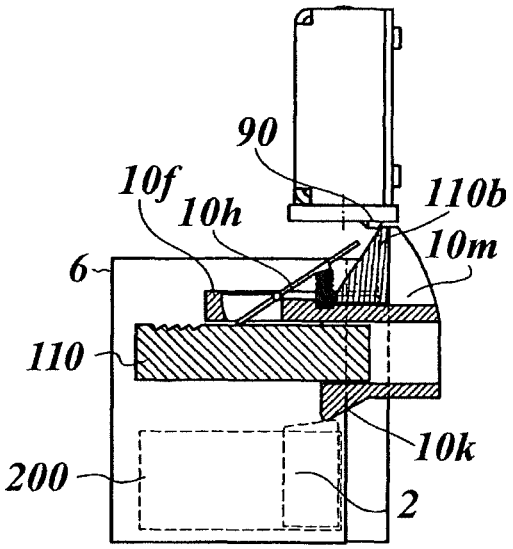
Figure 10C:
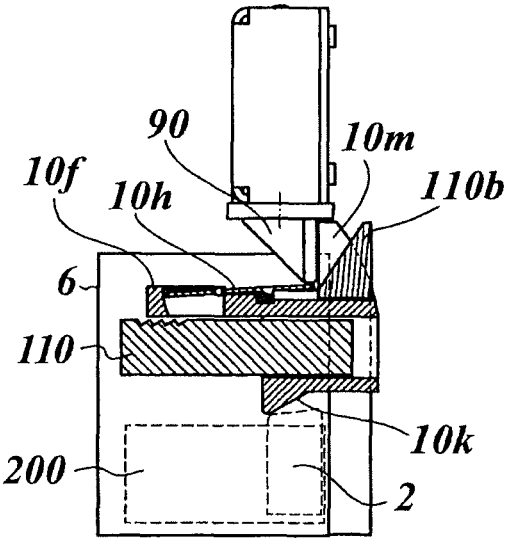
Figure 10D:
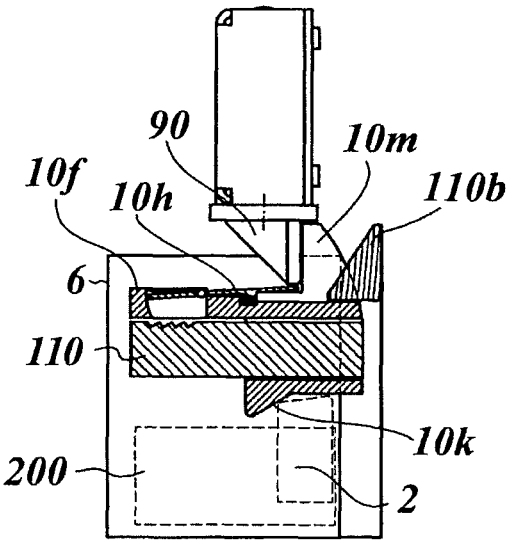

The drive output member 2 of the adjusting device 200 is then actuated again and now pivots the door opener latch 1 back into its horizontal position in FIG. 9*c*. In that case the arresting lever 10*h* is pivoted to such an extent that it comes out of engagement with the latching recesses of the mounting body 110. The compression spring 10*r* acting on the arresting lever 10*h* is of such a size that the lock latch 90 is not overridden in the pivotal movement of the arresting lever 10*h* (FIG. 9*c*).

The latch body 10 is now released again so that the drive output member 2 of the adjusting device 200 can push the latch body 10 back in the direction of the pivot axis 110*s* when sliding along the wedge surface 10*k* of the latch body. In that case the door leaf is entrained by way of the lock latch 90 until it bears against the door frame (not shown in FIGS. 9*a* through 9*d*) and the door is in the closed position. In the closed position of the door the latch body 10 bears in rattle-free contact against the lock latch 90.

It is provided that the adjusting device 200 also operates as a locking device which prevents the door leaf from being pulled open. When the door opener latch 1 is released it can either be provided that the adjusting device 200 pulls the drive output member 2 back or the drive output member 2 can be overridden. In both cases the assembly will pass through the positions shown in FIGS. 9*a* through 9*d* in the reverse sequence, that is to say beginning at the position show in FIG. 9*d* to the position shown in FIG. 9*a*.

The adjusting device 200 thus forms a device for pulling the door leaf shut into its closed position. At the same time it forms a device for self-adjustment of the door opener latch 1 insofar as the device provides that the door opener latch 1 is automatically put into a condition of rattle-free contact against the lock latch 90 in the closed position of the door.

When the door is opened the arrangement passes through the positions in the sequence of FIG. 9*d*, 9*c*, 9*b*, 9*a*. When the door is closed the arrangement passes through the positions in the sequence FIGS. 9*a*, 9*b*, 9*c*, 9*d*.

FIGS. 10*a* through 10*d* show a ninth embodiment, wherein the device is substantially like the device shown in FIGS. 9*a* through 9*d*, with the difference that there is further provided a lock latch actuating body 110*b* and the mounting body 110 is not pivotable but is arranged stationarily on the housing 6. The lock latch actuating body 110*b* has a straight front surface and an inclined rear surface. The straight front surface of the lock latch co-operates with the inclined surface of the door opener latch when the door is being closed in order to override the lock latch in the closing movement. The inclined rear surface of the lock latch co-operates with the rearward straight portion of the lock latch 90 when the door is being opened in order to override the lock latch 90 in the opening movement. In the door closing movement the arrangement passes through the positions in the sequence of FIG. 10*a*, 10*c*, 10*d*. In the door opening movement the arrangement passes through the positions in the sequence of FIG. 10*d*, 10*c*, 10*b*, 10*a*.

Figure 12:
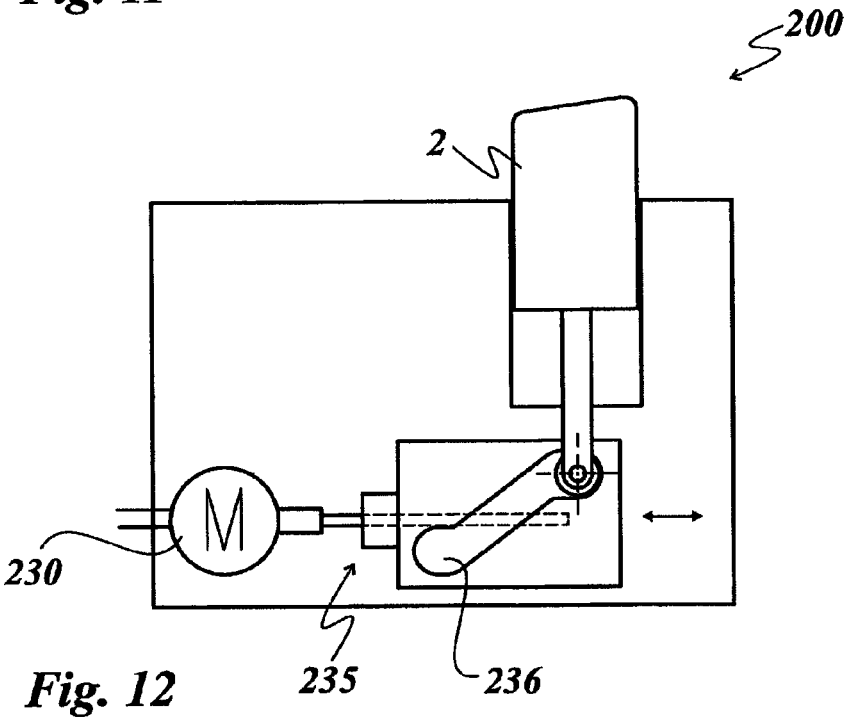
Figure 13:
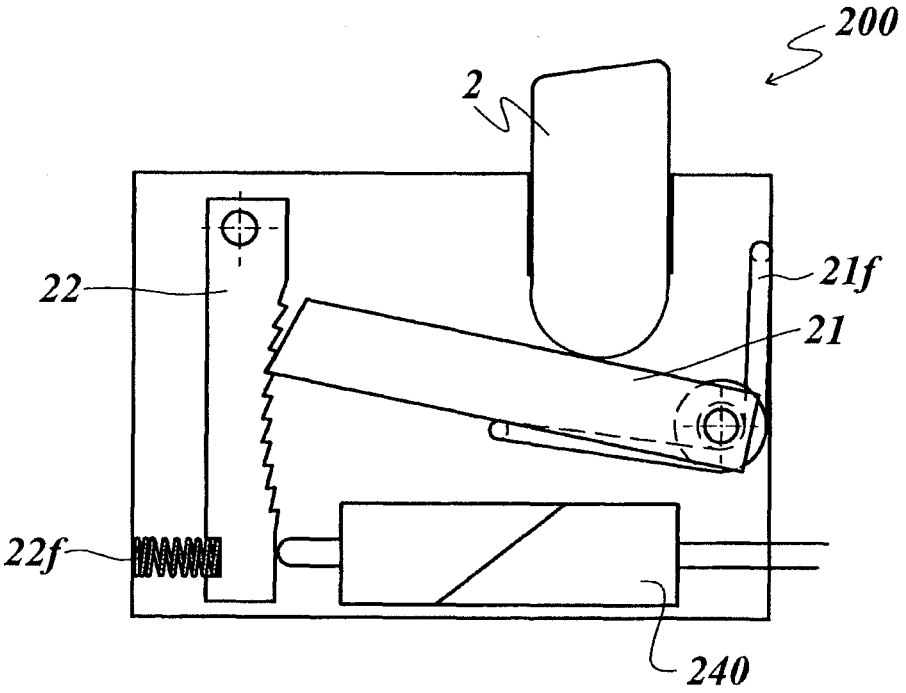

FIGS. 11 through 13 now show an embodiment of the adjusting device 200.

FIG. 11 shows an adjusting device 200 on a hydraulic basis. The drive output member 2 is in the form of a working piston 2*k* of a piston-cylinder device 20 which can be connected to a hydraulic pump 220 by way of a magnetic closure valve 5. The valve 5 has a valve spool with three switching chambers arranged in succession in the longitudinal direction of the valve spool. There is also a hydraulic spring storage device 30 which can also be connected to the hydraulic pump 220 by way of the valve 5. The hydraulic pump 220 generates the required operating pressure in the hydraulic circuit.

In a first position of the valve 5 the connections of the piston-cylinder device and the spring storage device 30 to the hydraulic pump 220 are interrupted. The drive output member 2, that is to say the piston of the piston-cylinder device 2, is locked against being pushed into the cylinder. Consequently the door opener latch 1 is locked.

In a second position of the valve 5 the hydraulic pump 220 is switched into the pressure mode with respect to the drive output member 2. When the pump 220 is switched on the drive output member 2 is urged in a direction out of the cylinder. When the hydraulic pump 220 is switched off, the spring of the spring storage device 30 is stressed when the drive output member 2 is pushed into the cylinder of the piston-cylinder device 20 so that the drive output member 2 is urged under the effect of the spring in a direction out of the cylinder of the piston-cylinder device when it is not loaded or is only slightly loaded.

In a third position of the valve 5 the hydraulic pump 220 is switched into the suction mode with respect to the drive output member 2. Consequently the drive output member 2 is pulled into the cylinder of the piston-cylinder device 20 in the release position and at the same time the spring of the spring storage device 30 is stressed.

FIG. 12 shows a second embodiment of the locking device 200. An electromechanical rotational motor 230 drives a screw spindle transmission 235 whose drive output member continuously performs a linear movement along the longitudinal axis of the drive output shaft of the motor 230, in the manner of a spindle nut on the screw spindle, and has a Z-shaped guide cam 236. The drive output member 2 of the control device 200 is guided linearly as a piston in the cylinder and at its lower end portion has a roller which rolls in the guide cam 236. The two end portions of the guide cam 236 are directed perpendicularly to the straight guide line of the drive output member 2 and are connected by an inclinedly extending guide portion. As a consequence of the end portions of the guide cam 236 being directed perpendicularly to the straight guide line of the drive output member 2, this arrangement involves a self-locking cam transmission, the screw spindle transmission 235 also being a self-locking transmission. Consequently upon any interruption in current the door opener latch 1 is locked in any position.

The embodiment shown in FIG. 13 has a ratchet switching transmission for movement of the drive output member 2.

A first rotatably mounted spring-loaded lever 21 is in the form of a switching pawl and co-operates with the drive output member 2 of the adjusting device 200. The lever 21 is urged by a leg spring 21*f* against the rear arcuate end portion of the drive output member 2.

A second rotatably mounted spring-loaded lever 22 is arranged at an angle relative to the first lever 21 and, at the longitudinal side towards the lever 21, has a sawtooth-shaped switching portion which is in the shape of a circular arc and into which the pawl portion of the lever 21 engages. Arranged between the end portion of the lever 21, that is remote from the rotary mounting, and the inside wall of the housing of the adjusting device, there is a compression spring 22*f* which acts on the long side of the lever 22, that is towards the inside wall of the housing. Arranged at the opposite long side of the lever 22 is a solenoid 240 whose longitudinal axis is aligned with the longitudinal axis of the compression spring 22*f* which is in the form of a coil compression spring, and whose linearly movable drive output member bears against the lever 22.

The recesses in the sawtooth-shaped switching portion of the lever 22 are of a shape which is congruent with the switching portion of the lever 21 and are so directed that the drive output member 22 cannot be pushed back, that is to say it cannot be moved downwardly. The drive output member 2 is consequently locked in one direction. The drive output member 2 can be unlocked by actuation of the solenoid 240, in which case the switching portion of the lever 21 comes out of engagement for the sawtooth-shaped switching portion of the lever 22, for the period of actuation.

When the solenoid 240 is actuated for a short time the lever 21 is moved further by a respective tooth in a direction towards the drive output member 2, wherein the working capacity of the drive output member 2 is determined by the spring force of the leg spring 21*f*. When the solenoid 240 is actuated for a long period the leg spring 21*f* moves the drive output member 2 until the closed position of the door is reached, as described hereinbefore with reference to FIGS. 9*a* through 9*d*. The leg spring 21*f* therefore acts as a servomotor, here therefore a spring motor.

It is also possible for only one locking direction to be provided with the described device. In that case the important consideration is that the spring force of the compression spring 22*f*, having regard to the lever relationships and the spring force of the leg spring 21*f*, is so slight that the leg spring urges the first lever 21 out of the latching recess—in which case the second lever 22 compresses the compression spring 22*f*—, until the lever 21 bears against the drive output member 2 and in so doing falls into one of the latching recesses. As stated hereinbefore therefore the drive output member 2 is locked until the solenoid 240 pivots the second lever 22 in a direction towards the compression spring 22*f* and the first lever 21 drops out of the latching recess.

LIST OF REFERENCES

F catch element
FS axis of rotation
FZ prong
FA trigger device
FL1 first sub-element of the linear door opener latch
FL2 second sub-element of the linear door opener latch
FS1 first sub-element of the pivotal opener latch
FS2 second sub-element of the pivotal opener latch
FB spring hinge band
M motor assembly
R counterpart element (bolt)
S lock latch
TF door leaf
TR stationary door frame
TO door opener
1 door opener latch
2 drive output member
5 locking valve
6 housing
10 displaceable latch body
10*a* abutment end
10*e* arresting engagement end
10*h* arresting lever
10*m* entrainment portion
10*f* release abutment
10*k* wedge surface
10*m* entrainment portion
21 first spring-loaded lever
21*f* leg spring
22 second spring-loaded lever
22*f* compression spring
30 hydraulic spring storage device
90 lock latch
110 mounting body
110*b* lock latch actuating body
110*s* pivot axis
200 adjusting device
220 hydraulic pump
230 electromechanical rotational motor
235 transmission
236 guide cam
240 solenoid

The invention claimed is:

1. A door closing device for a door having a door leaf mounted movably to a stationary door frame, the device comprising:

a catch device for mounting to the stationary door frame, the catch device being at least one of externally powered or spring force-powered, and a counterpart element co-operating with the catch device for pulling the door leaf shut, for mounting to the door leaf, wherein a) the catch device has a catch element which is mounted movably and a drive assembly connected to the catch element, wherein the drive assembly is at least one of externally powered or force storage means-powered, b) the counterpart element is in the form of a lock latch which can be overridden upon closure of the door and which is mounted at the door leaf side on a spring and has an inclined portion which comes into operation in the closing movement, c) the drive assembly functions as a motor assembly for pulling the door leaf shut and in addition forms a locking device of a door opener to arrest the door leaf in the closed position, d) the catch element is in the form of a pivotable door opener latch co-operating with a drive output member of the drive assembly, wherein the door opener latch is formed by a mounting body and a latch body movable relative to and mounted displaceably on the mounting body, and wherein the latch body can be fixed on the mounting body by means of an arresting device actuable by way of direct contact with the lock latch, e) for pulling the door leaf shut the door opener latch can be connected to and disconnected from the lock latch so that the door opener latch can be brought into engagement with the lock latch in the pulling-shut range of the door leaf and can be brought out of engagement with the lock latch outside the pulling-shut range, and f) for arresting the door leaf in the closed position of the door the locking device co-operates directly or indirectly with the door opener latch in such a way that the door opener latch is switchable into a locking position in which the door opener latch is blocked against a pivotal movement and a release position in which the door opener latch is released for pivotal movement.

2. The door closing device as set forth in claim 1, wherein the drive assembly or locking device engages the latch body for at least one of driving or fixing the mounting body of the door opener latch.

3. The door closing device as set forth in claim 1, wherein the door opener latch has an inclined portion with which the door opener latch comes into contact at the lock latch for pulling the door shut.

4. The door closing device as set forth in claim 1, wherein the door opener latch is mounted at least one of rotatably or linearly displaceably.

5. The door closing device as set forth in claim 1, wherein the door opener latch (1) on the one hand is pivotable about an axis of rotation arranged parallel to the door frame opening plane and on the other hand is linearly displaceable in a plane of movement which is arranged perpendicularly to the door opening plane.

6. The door closing device as set forth in claim 1, wherein the catch device has a switch device which can actuate the motor assembly and which comes into operative relationship with the lock latch upon closure of the door before the door opener latch comes into engagement with the lock latch.

7. The door closing device as set forth in claim 1, wherein the drive assembly has an electric motor assembly.

8. The door closing device as set forth in claim 7, wherein the electric motor assembly is in the form of an electromechanical motor with a drive output shaft which can be coupled to the catch element.

9. The door closing device as set forth in claim 7, wherein the electric motor assembly (M) is in the form of an electrohydraulic motor which is connected in a hydraulic circuit by which the catch element is drivable.

10. The door closing device as set forth in claim 1, wherein the drive assembly has a ratchet switching transmission controllable with at least one of an electric motor assembly or an electric solenoid assembly.

11. The door closing device as set forth in claim 1, wherein the drive assembly is in the form of a pneumatic motor assembly.

12. The door closing device as set forth in claim 1, wherein the drive assembly has a spring storage assembly having a return spring which can be positively acted upon when the door is opened.

13. The door closing device as set forth in claim 1, wherein integrated in the door closing device is a door opener in the form of a remotely actuable arresting device for a door.

14. The door closing device as set forth in claim 1, wherein the locking device is formed by the drive device insofar as locking of the door opener latch is effected by a self-locking action of the drive assembly.

15. The door closing device as set forth in claim 1, wherein in addition to the catch device there is provided a door closer which can be permanently coupled to the door leaf and the stationary door frame over the entire door opening range.

16. The door closing device as set forth in claim 15, wherein the door closer is in the form of a spring hinge band.

17. The door closing device as set forth in claim 16, wherein the door closer has a closer housing with a closer shaft and a closer spring mounted therein, wherein the housing can be mounted on the door leaf or the stationary door frame and the closer shaft can be permanently coupled to the door leaf or the door frame directly or by way of a force-transmitting linkage.

18. The door closing device as set forth in claim 1, wherein the door opener latch is at least one of such a configuration or so mounted that the door opener latch can perform a maximum adjusting travel which is Y-times the door leaf thickness, wherein Y is of a value of between 2 and 0.5.

19. The door closing device as set forth in claim 1, wherein the door opener latch is at least one of so adapted or so mounted that the door opener latch can perform a maximum adjusting travel of X mm, wherein X is a value of between 2 and 20.

20. The door closing device as set forth in claim 1, wherein a catch portion of the door opener latch is provided at the free end of the catch element.

21. A door closing device for a door having a door leaf mounted movably to a stationary door frame, the device comprising:

a catch device for mounting to the stationary door frame, the catch device being at least one of externally powered or spring force-powered, and a counterpart element co-operating with the catch device for pulling the door leaf shut, for mounting to the door leaf, wherein a) the catch device has a catch element which is mounted movably and a drive assembly connected to the catch element, wherein the drive assembly is at least one of externally powered or force storage means-powered, b) the counterpart element is in the form of a lock latch which can be overridden upon closure of the door and which is mounted at the door leaf side on a spring and has an inclined portion which comes into operation in the closing movement, c) the drive assembly functions as a motor assembly for pulling the door leaf shut and in addition forms a locking device of a door opener to arrest the door leaf in the closed position, d) the catch element is in the form of a door opener latch co-operating with the drive output member of the drive assembly, wherein the door opener latch is formed by a mounting body and a latch body movable relative to and mounted displaceably on the mounting body, and wherein the latch body can be fixed on the mounting body by means of an arresting device actuable by way of direct contact with the lock latch, e) for pulling the door leaf shut the door opener latch can be connected to and disconnected from the lock latch so that the door opener latch can be brought into engagement with the lock latch in the pulling-shut range of the door leaf and can be brought out of engagement with the lock latch outside the pulling-shut range, and f) for arresting the door leaf in the closed position of the door the locking device co-operates directly or indirectly with the door opener latch in such a way that the door opener latch is switchable into a locking position and a release position.

* * * * *

UNITED STATES PATENT AND TRADEMARK OFFICE

CERTIFICATE OF CORRECTION

PATENT NO. : 9,255,425 B2
APPLICATION NO. : 13/388189
DATED : February 9, 2016
INVENTOR(S) : Norman Wittke et al.

It is certified that error appears in the above-identified patent and that said Letters Patent is hereby corrected as shown below:

ON THE TITLE PAGE

Item (73) Assignee: "Sicherheitechnik" should read --Sicherheitstechnik--

Signed and Sealed this
Third Day of May, 2016

Michelle K. Lee

Michelle K. Lee
*Director of the United States Patent and Trademark Office*